US008651180B2

(12) United States Patent
Jara

(10) Patent No.: US 8,651,180 B2
(45) Date of Patent: Feb. 18, 2014

(54) HYDRAULIC PACKER CONSTRUCTED IN GLASS-FIBER REINFORCED EPOXY AND STAINLESS STEEL

(76) Inventor: Gustavo Martin Jara, Neuquen (AR)

( * ) Notice: Subject to any disclaimer, the term of this patent is extended or adjusted under 35 U.S.C. 154(b) by 222 days.

(21) Appl. No.: 13/186,405

(22) Filed: Jul. 19, 2011

(65) Prior Publication Data

US 2011/0272138 A1 Nov. 10, 2011

Related U.S. Application Data

(63) Continuation-in-part of application No. 12/255,041, filed on Oct. 21, 2008, now abandoned.

(30) Foreign Application Priority Data

Oct. 26, 2007 (AR) ..... M070104752

(51) Int. Cl.
*E21B 33/12* (2006.01)

(52) U.S. Cl.
USPC ..... 166/179; 166/120

(58) Field of Classification Search
USPC ..... 166/120, 179
See application file for complete search history.

(56) References Cited

U.S. PATENT DOCUMENTS

| | | | | |
|---|---|---|---|---|
| 4,044,826 | A * | 8/1977 | Crowe | 166/120 |
| 5,095,978 | A * | 3/1992 | Akkerman et al. | 166/120 |
| 5,327,962 | A | 7/1994 | Head | |
| 6,769,491 | B2 * | 8/2004 | Zimmerman et al. | 166/387 |
| 2003/0000710 | A1 | 1/2003 | Turley | |
| 2003/0226668 | A1 | 12/2003 | Zimmerman | |

FOREIGN PATENT DOCUMENTS

| | | |
|---|---|---|
| GB | 2287734 | 9/1995 |

* cited by examiner

*Primary Examiner* — Giovanna Wright
(74) *Attorney, Agent, or Firm* — Defillo & Associates, Inc.; Evelyn A Defillo

(57) ABSTRACT

A hydraulic packer including a chamber and at least one piston that slides down inside said chamber. The entire mandrel is made of a glass-fiber composition including glass-fiber 30%, resin 60%, and epoxy with accelerator 10%.

12 Claims, 2 Drawing Sheets

HYDRAULIC PACKER CONSTRUCTED IN GLASS-FIBER REINFORCED EPOXY AND STAINLESS STEEL

CROSS-REFERENCE TO RELATED APPLICATION

Figure 1:
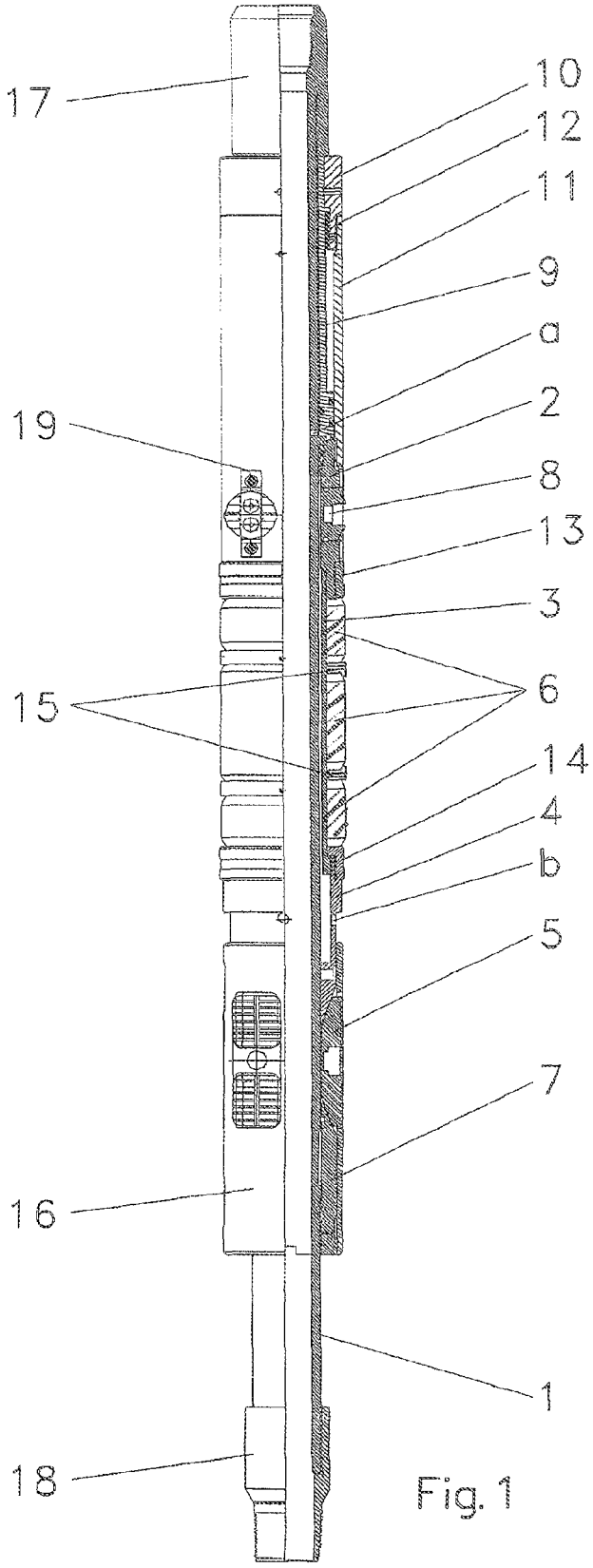

This application is a continuation-in-part of U.S. patent application Ser. No. 12/255,041 filed Oct. 21, 2008, now abandoned, which claims priority over Argentinean Patent Application No. M20070104752 filed Oct. 26, 2007.

FIELD OF THE INVENTION

The present invention refers to a hydraulic packer made entirely of a glass-fiber composition and stainless steel.

BACKGROUND OF THE INVENTION

In order to get a better understanding of this invention so that it can be put into practice easily, a detailed description will be given in the following paragraphs about the best way to carry out the invention; making reference in the description to the attached drawings, the whole with character of purely demonstrative example but not restrictive to the invention. Its components can be selected among several equivalents without leaving aside the principles of the invention established in this documentation.

Patent GB2287734 includes seals which have non-metallic springs. One or more springs are contained in an elastomeric body used as a seal between telescopic components such as a water well and cover. The springs are ordered annularly in the body which is made of a non-metallic material (for example engineering plastics, composed of graphite or glass-fiber, KEVLAR® or PEEK®), able to be strongly connected to the body and softer than the seal surfaces to avoid risk of scratching or damaging from springs. Electrolytic corrosion risk is also avoided.

Patent Application Publication No. US2003000710 includes a resin impregnated plug of the continuous fiber with non-metallic elements. A system of non-metallic elements is provided which can seal or close efficiently an annular space under high temperatures. The system can also resist high differential pressures without sacrificing operation or suffering a mechanical degradation and it is considerably faster than drilling upwards as in a conventional system. In another aspect, the material composed covers a mixture of reinforced epoxy resin with layers of glass-fiber superimposed about 30 to nearly 70 degrees. A device such as a bridge plug or a packer is also provided. The device comprises a first and a second helping ring that has one or more sharpened wedges, first and second ring of the extension, and a sealing member disposed between the rings of the extension and the helping rings.

Patent Application Publication No. US2003226668 includes a system that anchors or seals for a drilling device.

Finally, U.S. Pat. No. 5,327,962 is studied, and consists of a packer. An inflatable packer which includes several annular layers of material, which consists of a series of oriented fibers encapsulated in an elastomeric resin, the inner and outer circumferential, the surfaces of the packer, each of which has a protective layer of material effective to protect the elastomeric resin, each protecting layer 9, 11, are placed in the packer in a folded manner, in such a way that the unfolding of the layers enables the inflation of the packer.

Having studied the preceding quoted documentation, it is concluded that the same is not a hindrance for this application.

SUMMARY OF THE INVENTION

The present invention is generally related to a method and a device to seal an annular space in a well. In one aspect, the present invention relates to a system that anchors and seals for a drilling device such as a bridge plug or packer. The sealing system comprises a component of the same disposed between a ring system, an expansion ring system adjacent to each cone, a helping ring system and a slider system. The sealing system components are adjusted in such a manner that when they are comprised, the sealing member can be expanded in a radial way in contact with a cover.

The hydraulic packer may be constructed in its entirety of a special glass-fiber reinforced epoxy composition and stainless steel. The mandrel may be completely constructed of the special glass-fiber reinforced epoxy composition. Due to the increasing problems of corrosion in wells caused by chemical and bacteriological agents present in the production and injection fluids, the conventional devices for wells made of carbon steel have scarce durability and this provokes very expensive replacements.

It is prevailing then, to develop new devices that, being reliable in their operation, also have a useful life substantially higher than the traditional ones.

The hydraulic packer presented has been developed and designed with wholly corrosion resistant material, and is constructed with 70% of special glass-fiber reinforced epoxy composition and 30% of chrome stainless steel.

Because of its component material, this is an ecological device that avoids well pollution due to corrosion products and it contributes to protecting the environment.

Due to its durability and corrosion resistance, it is intended to offer operative solutions through time, and contribute to protecting the environment.

BRIEF DESCRIPTION OF THE DRAWING(S)

Figure 2:
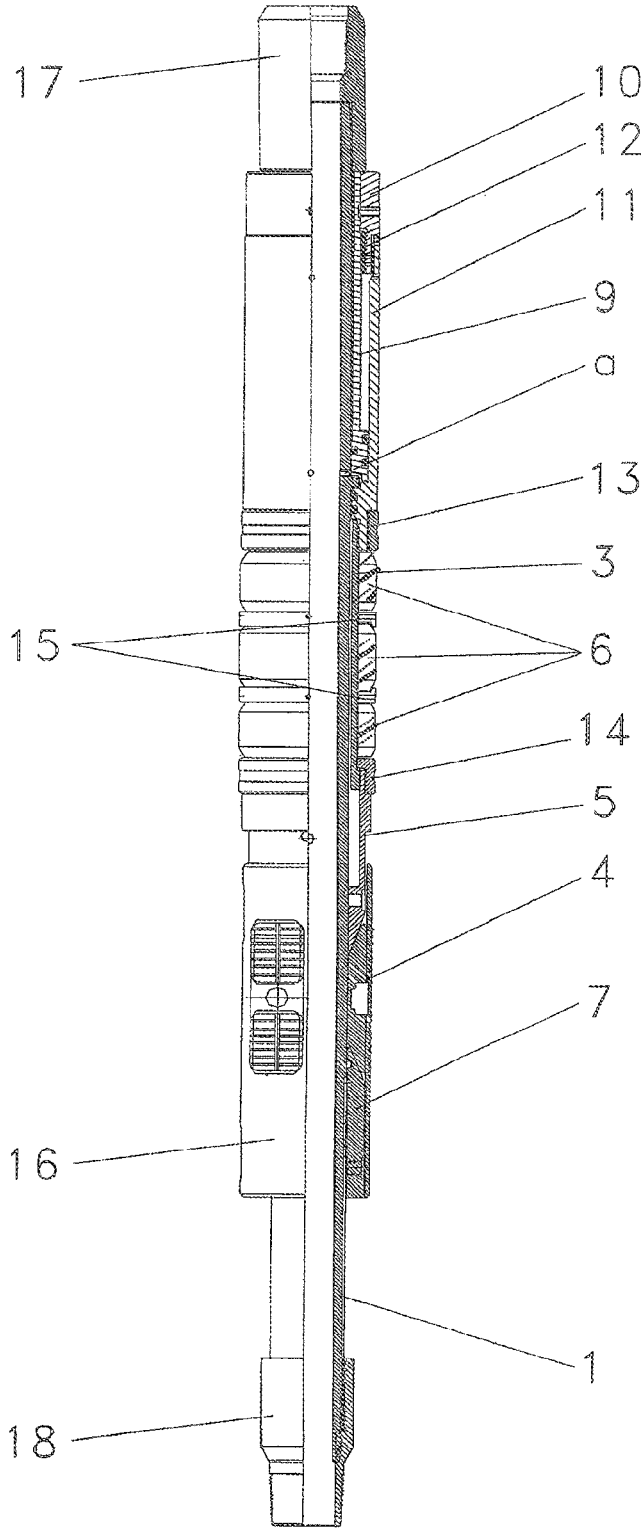

FIG. 1 illustrates a cross-sectional view of the hydraulic packer of the present invention showing all of the components; and FIG. 2 illustrates a cross-sectional view of a second embodiment of the hydraulic packer according to the present invention.

DETAILED DESCRIPTION OF THE PREFERRED EMBODIMENT(S)

The figures described the same reference characters, to indicate parts alike or corresponding, being mandrel 1; piston carrier 2; element retainer sleeve 3, upper cone 4: jaw 5, packing elements 6; lower cone 7; pistons 8; fixing mandrel 9; pin holding nut 10; sleeve 11; and restraint ring 12. Upper calibration ring 13; lower calibration ring 14; spacer rings 15; jaw holder 16; upper header 17; lower header 18; and piston strip 19.

At the same time, reference-a—indicates the entrance hole and reference-b—indicates the admission holes.

This development basically consists of a hydraulic packer constructed of special glass-fiber reinforced epoxy composition and stainless steel.

The hydraulic packer may be used to isolate oil, gas or water layers. The hydraulic packer may be hydraulically operated by means of pressure applied from the surface of the well.

To begin with, the hydraulic packer includes a hydraulic piston system that slides down inside a chamber. When providing differential pressure, and thanks to the fixing zones which are part of the device, the device is driven to one of the ends, thus achieving the anchorage and the packing of elements.

At the same time, the sleeve and piston have a jack system which prevents the device from going back when giving pressure and to support its anchorage and packing with a certain strength, which is given by the areas of the piston, the mandrel and the hydraulic sleeve.

To begin with, it works as a piston with the difference that when the pressure is taken out it does not turn back since it is held by a jack that supports all the strength of the anchorage and packing.

Since this device is a cylindrical hybrid, it is machined with conventional machines, such as industrial lathes and industrial milling cutters. All of the parts of this device go through a turning and milling process, including the stainless steel and the glass-fiber reinforced epoxy parts.

In regards to the parts made of glass-fiber reinforced epoxy, the raw material is in the manner of cylindrical bars, which are machined with machine devices such as lathes and milling cutters.

The machining of the special glass-fiber reinforced epoxy composition elements is carried out in a conventional manner, by only changing the turning advancing and the chip removal, since it is a material more brittle than steel.

On the other hand, the operative innovation that this device has is a larger area of packing and seal, due to its system of strong packing elements, specially adapted for this device. It works with low pressure of operation, which reduces accident risks.

Its chamber was specially designed to achieve a larger strength of packing at normal pressure, and it enables its use in wells with glass-fiber reinforced epoxy tubing, without the need to do the double fixing stroke with steel tubing of conventional devices.

It has a double anchorage system, specially designed to anchor in casing of special glass-fiber reinforced epoxy composition, without damaging it and avoiding the displacement of the packer when the well is operating.

Once the different components of the invention version are established and developed in order to explain their nature, the description is then complemented with the functional and operating relation of its parts and the results they provide.

In order to obtain a hydraulic packer constructed in the special glass-fiber reinforced epoxy composition and stainless steel, it is hydraulically operated by means of pressure applied from the surface of the well. Such liquid goes through the entrance hole (a) from the mandrel 1 and moves the piston holder 2, the element holder sleeve 3 and the upper cone 4. This one, due to its conical shape in its lower end, moves the jaw 5 outwards until it hits the casing (not represented). When this occurs, the piston holder 2 and the element holder sleeve 3 goes on advancing, compressing the packing elements 6 and the lower cone 7 joined to the mandrel 1.

It is important to mention that the mandrel 1 is completely made of a special glass-fiber reinforced epoxy composition, while the piston holder 2, the element holder sleeve 3, the upper cone 4, the jaw 5 and the lower cone 7 are made of steel SAE 4140 N with nickel-plating superficial treatment. On the other hand, the packing elements 6 are made of acrylonitrile.

This model represents a set with pistons 8 prepared to operate in wells where there are differential pressures; that is to say, this packer is prepared to be anchored to the pipe with the jaws 5 and the pistons 8.

When the device is driven, it operates according to the above-mentioned description. The pistons 8 are operated by means of the ground pressure of the fluid that enters through the admission holes (b) of the upper cone 4, goes along the mandrel 1, the element holder sleeve 3 and then gets below the pistons 8. In this way the fluid pressure moves them outwards and anchors them in the casing (not represented). The pistons 8 are only activated when we have a well with ground pressure, to help this pressure not to move the packer and so have an effective grip of the device through the jaws 5 at the lower part and of the pistons 8 at the upper part. It can be observed that the pistons 8 hit in the piston strip 19.

When operating the device in its upper part, the fixing mandrel 9 is joined to the mandrel 1 and the pieces that slide down to the lower end of the packer is the pin holder nut that gets screwed to the hydraulic sleeve 11 that at the same time is joined with the piston holder 2 and the rest of the pieces, as it has already been explained. They slide through the movement that the restraint ring 12 does, which is inside the pin holder nut 10 and that works like a jack. At the same time the pressure pushes the hydraulic sleeve 1 with the piston holder 2 and the rest of the pieces. The restraint ring 12 is advancing and restraining at the same time. It is fixing in the saw thread of the fixing mandrel 9, since the restraint ring 12 has the same thread but counterclockwise.

Consequently, when the packer is wholly activated, the restraint ring 12 supports all the packing and fixing of the jaws in the fixing mandrel 9, since it remains embedded in the saw tooth threads.

The pistons 8 are made of steel SAE 8620 with nickel-plating surface treatment, the fixing mandrel 9 can be made of steel SAE 4140 N with nickel-plating surface treatment or of stainless steel AISI 316L, the pin holder nut 10 and the restraint ring 12 are made of steel SAE 4140 N with nickel-plating surface treatment. The hydraulic sleeve 11 can be made of the special glass-fiber reinforced epoxy composition or stainless steel AISI 316L.

An upper calibration ring 13 and a lower calibration ring 14, both made of steel SAE 4140 N with nickel-plating surface treatment, being the first ring placed in the lower end of the element holder 3 and the second one in the initial end of the upper cone 4, which are used to calibrate the compression of the packing elements 6. These being the ones separated among themselves by the spacer rings 15. These can be obtained either in steel SAE 4140 N with nickel-plating superficial treatment or the special glass-fiber reinforced epoxy composition.

It is important to mention that the jaws 5 and the lower cone 7 are placed into the jaw holder 16 which can be either made of steel SAE 4140N with nickel-plating surface treatment or the special glass-fiber reinforced epoxy composition.

On the other hand, in this model, the mandrel 1 is connected to the rest of the components of the oil well by the upper header 17, placed in the first end of the packer and by the lower header 18 placed in the opposite end, both made of the special glass-fiber reinforced epoxy composition or of stainless steel AISI 316L.

After several years of search and research, the present inventor was able to produce a special glass-fiber reinforced epoxy composition that resists the high pressure of wells and to the wear and tear. The special glass-fiber reinforced epoxy composition includes:

| | |
|---|---|
| Glass-fiber | 30% |
| resin | 60% |
| epoxi with accelerator | 10%. |

The accelerator may produce a chemical reaction that hardens the mixture of glass-fiber with the resin. The accelerator may increase the speed reaction of the hardness of the mixture of glass-fiber with the resin.

In addition, the special glass-fiber reinforced epoxy composition may include up to 3% of acetone and up to 6% of monometer.

70% of the hydraulic packer may be made of the special glass-fiber reinforced epoxy composition and 30% of steel. The mandrel 1 is completely made of the special glass-fiber reinforced epoxy composition. Because the special glass-fiber reinforced epoxy composition of the mandrel 1, the hydraulic packer can be injected with seawater.

The special glass-fiber reinforced epoxy composition of the mandrel 1, combined with the steel material of the remaining components of the hydraulic packer, provides the device with a durability that increases the working life of the device from 2 years to over 10 years. This significantly reduces the maintenance cost of the device. In addition, the special glass-fiber reinforced epoxy composition of the mandrel 1, combined with the steel material of the remaining components of the hydraulic packer, produces a device that does not contaminated the fluid.

In some embodiments, the tubing, chamber, and sleeve of the hydraulic packer may be also made of the special glass-fiber reinforced epoxy composition of the mandrel 1. The jaws are adapted to lock on the components made of the special glass-fiber reinforced epoxy composition. The prior art did not show the pipes made of the special glass-fiber reinforced epoxy composition; thus, the prior art was not able to lock the jaws into the pipes.

Packing elements may be made of the special glass-fiber reinforced epoxy composition. Because of the toughness of its packing elements, with a fixing pressure of 2300 PSI, these can remain with 8 tons of weight without compromising the hydraulic seal.

Due to its hydraulic fixing mechanism, the hydraulic packer of the present invention is useful in wells in which its fixing and the assembling of the tubing string are performed in the same equipment operating stroke.

The hydraulic packer of the present invention has a packing area larger than the one typically used in this type of packers.

The hydraulic packer of the present invention is easy to operate both in its fixing and its recovery. Once the hydraulic packer is fixed, it can remain with weight, tension or in state of neutral load, without pressure and/or temperature changes modifying its fixing condition and packing.

The hydraulic packer has an anchorage device having jaws with special teeth that are compatible with the glass-fiber reinforced epoxy and the steel.

The fixing and packing are achieved by applying pressure inside the tubing using a disposable tap or check-valve to seal off the string temporarily during this operation phase. In injection wells, if it is necessary to remove the tubing without moving the packer and temporarily leave this one as a tap, an ON-OFF connector, such as MMS-CCJD is used.

The hydraulic packer includes a release system by rotation that saves operating equipment time, since its low fixing pressure, it can be deepened by using the same tubing string at the end of the well. The hydraulic packer may be easily rotated in case of any fishing maneuver and has a release system by means of alternative tension.

For fixing, it is necessary to select the number of pins and their cutting pressure, to achieve a correct packing. In case of combining this packer with a disposable tap, the cutting pressure of pins must be at least 1000 PSI above the corresponding one to the fixing of the packer.

The user may descend the hydraulic packer to the desired depth and fill the inside of the string of the tubing and the in-between column. Then, the user may pump water directly until the corresponding pressure to the cutting safety pins is achieved. Once the cut is achieved, continue pressurizing up to 2300 PSI, final fixing pressure.

In case of using a disposable tap, continue pressurizing to the cutting of the safety pins. The user may take into account that the indicated pressure values are nominal. Any difference of fluid levels between the tubing string and the in-between column will modify the effective pressure values to which this device is subjected to.

During the release, the user may look for the tubing neutral point to the depth of the hydraulic packer, tension between 2500 and 3000 Lbs., give 4 to 6 turns clockwise to the tubing string, wait for pressure leveling in the packer during some seconds and raise slowly.

TABLE OF CUTTING PRESSURE OF #3/8 FIXING BRONCE BOLTS

| Bolt quantity | Kg/Cm2 | Psi |
|---|---|---|
| 1 | 28 | 400 |
| 2 | 56 | 800 |
| 3 | 84 | 1200 |
| 4 | 112 | 1600 |
| 5 | 140 | 2000 |
| 6 | 168 | 2400 |

When fluid enters the hydraulic chamber, the fluid enters with certain pressure that acts on the piston of the fixation mandrel in two-way traffic, one pushes the fixation mandrel. As the fixation mandrel is fixed, the pressure acts in its totality towards the other direction moving the hydraulic shirt forwards and compressing the rubber packer that drives the anchorage jaws. This way, the hydraulic packer is driven in the well fulfilling its function to pack to isolate the layers of water Injection.

Lastly, we have the operating example as it can be observed in the FIG. 2. Unlike the original model it does not have the piston holder 2, the pistons 8 and the piston strip 19. It has another configuration: the hydraulic sleeve 11 where the element holder sleeve 3 and the upper calibration ring 13 are fixed. The rest of the components are similar to the original model except the length of the mandrel 1 and the absence of the admission holes (b) of the upper cone 4.

What is claimed is:

1. A hydraulic packer comprising:

a mandrel made entirely of a glass-fiber composition including:

| | |
|---|---|
| glass-fiber | 30% |
| resin | 60% |
| epoxy with accelerator | 10%. |

2. The hydraulic packer according to claim 1, wherein 70% of the hydraulic packer is made of the glass-fiber composition and 30% is made of a stainless steel material.

3. A hydraulic packer operated by a fluid pressure applied from a surface of a well, the hydraulic packer comprising:

a casing having an upper end and a lower end;

a mandrel running vertically through the casing, the mandrel is made entirely of a glass-fiber composition including:

| | |
|---|---|
| glass-fiber | 30% |
| resin | 60% |
| epoxy with accelerator | 10% |

an entrance hole located on the mandrel, the entrance hole allows entrance of the fluid under pressure;

at least one piston connected to the mandrel, the piston sliding radially outwardly inside the casing by action of the fluid pressure;

a piston holder operatively connected to the piston;

an element holder sleeve operatively connected to the mandrel;

an upper cone;

an upper calibrating ring located around a lower end of the element holder sleeve;

a lower calibrating ring located around a top end of the upper cone;

wherein the piston holder, the element holder sleeve, and the upper cone are formed from the stainless steel material having a nickel-plating;

wherein the fluid pressure slides radially outwardly the piston into an extended position anchoring the piston to the casing.

4. The hydraulic packer according to claim 3, further comprising:

a plurality of jaws which are movable outwardly by a lower end of the upper cone, wherein the jaws move radially outwardly until engaged in the casing;

a plurality of packing elements located between the upper calibration ring and the lower calibration ring; and a lower cone joined to said mandrel; and each of said jaws and said lower cone being formed from a steel material having a nickel plating.

5. The hydraulic packer according to claim 4, wherein each said packing element is made of acrylonitrile.

6. The hydraulic packer according to claim 3, wherein said upper cone has at least one fluid admission hole and said at least one piston is operated by seawater which enters through said at least one fluid admission hole.

7. The hydraulic packer according to claim 3, further comprising a fixing mandrel joined to the mandrel.

8. The hydraulic packer according to claim 7, wherein each of said pistons being made of a first stainless steel material with a nickel plating and wherein said fixing mandrel is being made from a second stainless steel material with a nickel plating.

9. The hydraulic packer according to claim 8, further comprising a pin holder nut operatively connected to a hydraulic sleeve that is connected to the piston holder.

10. The hydraulic packer according to claim 8, further comprising: a jaw holder made from the glass-fiber composition; and said jaws and said lower cone being placed into the jaw holder.

11. The hydraulic packer according to claim 8, further comprising: an upper header placed in a first end of the packer and a lower header placed in an opposite end; and each of said headers being formed from the glass-fiber composition.

12. A hydraulic packer operated by a fluid pressure applied from a surface of a well, the hydraulic packer comprising:

a casing having an upper end and a lower end;

a mandrel running vertically through the casing, the mandrel is made entirely of a glass-fiber composition including:

| | |
|---|---|
| glass-fiber | 30% |
| resin | 60% |
| epoxy with accelerator | 10% |

an entrance hole located on the mandrel, the entrance hole allows entrance of the fluid under pressure;

at least one piston connected to the mandrel, the piston sliding radially outwardly inside the casing by action of the fluid pressure;

a piston holder operatively connected to the piston;

an element holder sleeve operatively connected to the mandrel;

an upper cone having a top end and a conical shaped bottom end;

an upper calibrating ring located around a lower end of the element holder sleeve;

a lower calibrating ring located around the top end of the upper cone;

a plurality of jaws which are movable outwardly by the bottom end of the upper cone, wherein the jaws move radially outwardly until engaged in the casing;

a plurality of packing elements located between the upper calibration ring and the lower calibration ring; and a lower cone joined to said mandrel;

wherein the fluid pressure enters the casing by the entrance hole of the upper cone, the fluid pressure slides the piston radially outwardly into an extended position anchoring the piston to the casing;

wherein the conical shape of the bottom end of the upper cone moves the jaws outward until it hits the casing;

wherein when the jaws hit the casing, the piston holder and the element holder sleeve move, compressing the packing elements and the lower cone.

* * * * *